US006481400B2

(12) United States Patent
Hendriksma et al.

(10) Patent No.: US 6,481,400 B2
(45) Date of Patent: Nov. 19, 2002

(54) VALVE DEACTIVATION ASSEMBLY WITH PARTIAL JOURNAL BEARINGS

(75) Inventors: Nick J. Hendriksma, Grand Rapids, MI (US); Randal L. Bogucki, Orchard Park, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/962,395

(22) Filed: Sep. 25, 2001

(65) Prior Publication Data

US 2002/0011225 A1 Jan. 31, 2002

Related U.S. Application Data

(63) Continuation-in-part of application No. 09/664,668, filed on Sep. 19, 2000.

(60) Provisional application No. 60/176,133, filed on Jan. 14, 2000.

(51) Int. Cl.[7] ..... F01L 13/00; F02D 13/06

(52) U.S. Cl. ..... 123/90.16; 123/90.42; 123/198 F

(58) Field of Search ..... 123/90.15, 90.16, 123/90.39, 90.41, 90.42, 90.43, 90.44, 198 F

(56) References Cited

U.S. PATENT DOCUMENTS

| | | | | | |
|---|---|---|---|---|---|
| 4,768,467 | A | * | 9/1988 | Yamada et al. | 123/90.16 |
| 5,553,584 | A | * | 9/1996 | Konno | 123/90.16 |
| 5,669,342 | A | * | 9/1997 | Speil | 123/90.16 |
| 6,321,705 | B1 | * | 11/2001 | Fernandez et al. | 123/90.16 |
| 6,325,030 | B1 | * | 12/2001 | Spath et al. | 123/90.16 |

* cited by examiner

*Primary Examiner*—Weilun Lo
(74) *Attorney, Agent, or Firm*—Patrick M. Griffin

(57) ABSTRACT

A valve deactivation assembly includes an elongate camshaft having at least one lift lobe. The lift lobe has a lift portion and a base circle portion, and is affixed to or integral with the camshaft. A first null lobe is disposed on a first side of the lift lobe, and is affixed to or integral with the camshaft. A second null lobe is disposed on a second side of the lift lobe, and is affixed to or integral with the camshaft. A first journal bearing is disposed on the first null lobe, and a second journal bearing is disposed on the second null lobe. The journal bearings are configured for engaging a body of a deactivation roller finger follower to thereby reduce friction and wear of the roller finger follower body.

14 Claims, 2 Drawing Sheets

VALVE DEACTIVATION ASSEMBLY WITH PARTIAL JOURNAL BEARINGS

CROSS REFERENCE TO RELATED APPLICATIONS

This application is a continuation-in-part of U.S. patent application Ser. No. 09/664,668, filed Sep. 19, 2000 and entitled Roller Finger Follower for Valve Deactivation which, in turn, claims the benefit of U.S. Provisional Patent Application Serial No. 60/176,133, filed Jan. 14, 2000.

TECHNICAL FIELD

The present invention relates to cylinder and/or valve deactivation in internal combustion engines.

BACKGROUND OF THE INVENTION

Deactivation roller finger followers (DRFF's) typically include a body and a hollow shaft upon which is disposed a roller. A locking pin assembly is switchable between a coupled and decoupled position wherein the shaft is respectively coupled to and decoupled from the DRFF body. A pin of the locking pin assembly is disposed within and carried by the hollow shaft. An output cam of an engine camshaft engages the roller.

With the locking pin in the coupled position, the shaft is coupled to the DRFF body. The shaft transfers rotation of the output cam engaging the roller to pivotal movement of the DRFF body, which, in turn, actuates an associated engine valve. With the locking pin assembly in the decoupled position, the shaft is decoupled from the DRFF body. Thus, rotation of the output cam is not transferred to pivotal movement of the DRFF body. Rather, rotation of the output cam is transferred via the roller to reciprocation of the shaft within grooves formed in the RF body. Therefore, the associated valve is deactivated, i.e., not lifted or reciprocated. Lost motion springs absorb the reciprocation of the roller and maintain the roller in contact with the output cam when the DRFF is in the decoupled mode of operation.

The position of the DRFF body relative to the output cam is established, in part, by one or more surfaces on the DRFF body that engage null lobes of the camshaft, and is important to the proper and reliable switching of the locking pin assembly. Wear caused by friction between the null lobes and the surface of the DRFF body engaged thereby may result in a shift in the position of the DRFF body in a direction toward the camshaft and/or output cam. A shift in the position of the DRFF body in a direction toward, or away from, the output cam may adversely affect the operation of the locking pin assembly by, for example, making the exact timing of the mode switching event somewhat unpredictable.

Therefore, what is needed in the art is an apparatus that reduces the wear of the null lobes and/or the surface of the DRFF body engaged thereby.

Furthermore, what is needed in the art is an apparatus that reduces friction at the interfaces between the null lobes and the surface of the DRFF body engaged thereby.

Still further, what is needed in the art is an apparatus that reduces or substantially eliminates any shift in the position of the DRFF body relative to the camshaft, and thereby improves the reliability and predictability of the mode switching of the DRFF.

SUMMARY OF THE INVENTION

The present invention provides a valve deactivation system for use with internal combustion engines.

The invention comprises, in one form thereof, an elongate camshaft having at least one lift lobe. The lift lobe has a lift portion and a base circle portion, and is affixed to or integral with the camshaft. A first null lobe is disposed on a first side of the lift lobe, and is affixed to or integral with the camshaft. A second null lobe is disposed on a second side of the lift lobe, and is affixed to or integral with the camshaft. A first journal bearing is disposed on the first null lobe, and a second journal bearing is disposed on the second null lobe. The journal bearings are configured for engaging a body of a deactivation roller finger follower to thereby reduce friction and wear of the roller finger follower body.

An advantage of the present invention is that it reduces friction between the null lobes and the surface of the DRFF engaged thereby, which, in turn, significantly reduces wear of those surfaces.

A further advantage of the present invention is that shifting of the position of the DRFF body relative to the camshaft is reduced.

A still further advantage of the present invention is that it is more economical than using special materials and/or coatings for the interfacial surfaces.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplification set out herein illustrates the preferred embodiment of the invention and such an exemplification is not to be construed as limiting the scope of the invention in any manner.

DESCRIPTION OF THE PREFERRED EMBODIMENTS

Figure 1:
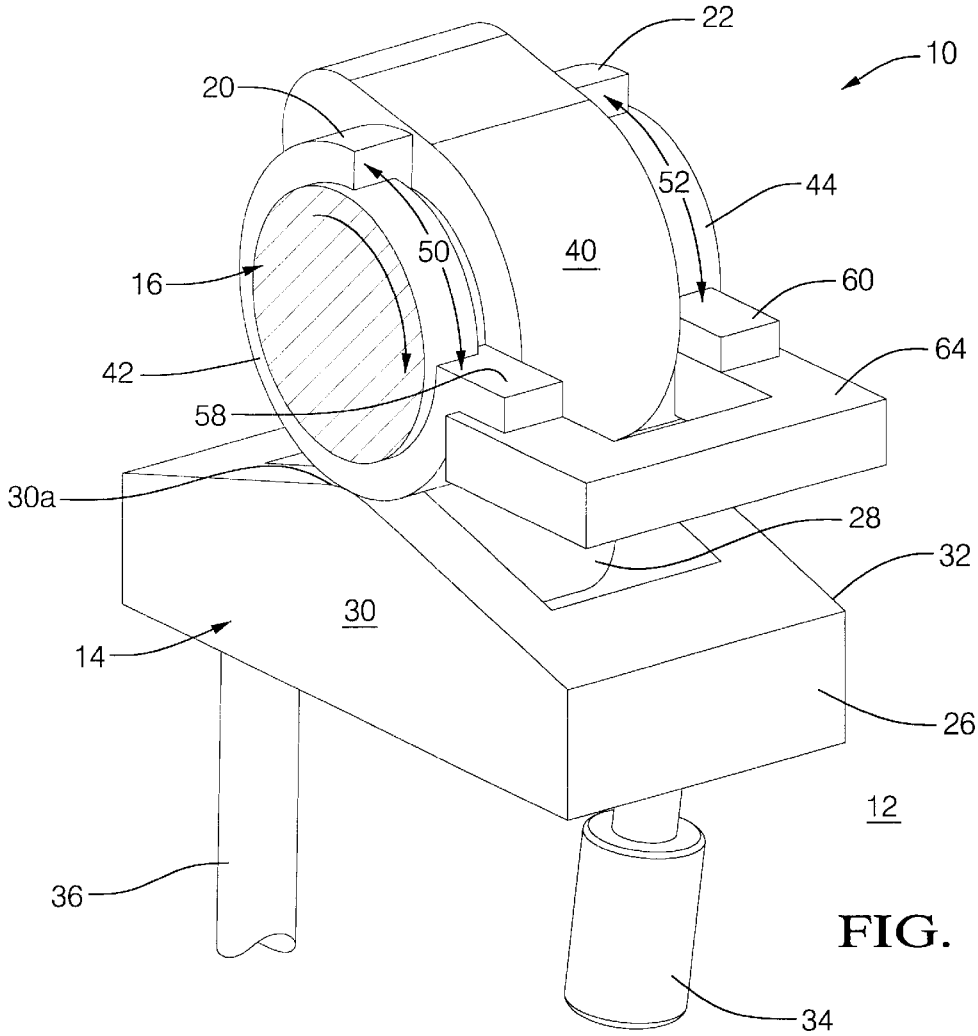
FIG. 1 is a perspective view of one embodiment of a valve deactivation assembly of the present invention operably installed in an engine.

Referring now to the drawings, and particularly to FIG. 1, there is shown one embodiment of a valve deactivation system of the present invention. Valve deactivation system 10 is operably installed in engine 12, and includes DRFF 14, camshaft 16 and partial journal bearings 20, 22.

DRFF 14 includes body 26 and roller 28. Body 26 includes sidewalls 30, 32, which define respective top surfaces 30*a*, 32*a* (only one shown). Top surfaces 30*a*, 32*a* are generally rounded and/or parabolic in shape. Top surfaces 30*a*, 32*a* are engaged by an outer axial surface (not referenced) of partial journal bearings 20, 22, respectively. A first end (not referenced) of DRFF body 26 engages hydraulic lash adjuster 34, and a second end (not referenced) engages valve stem 36 of a valve (not shown) of engine 12.

Figure 2:
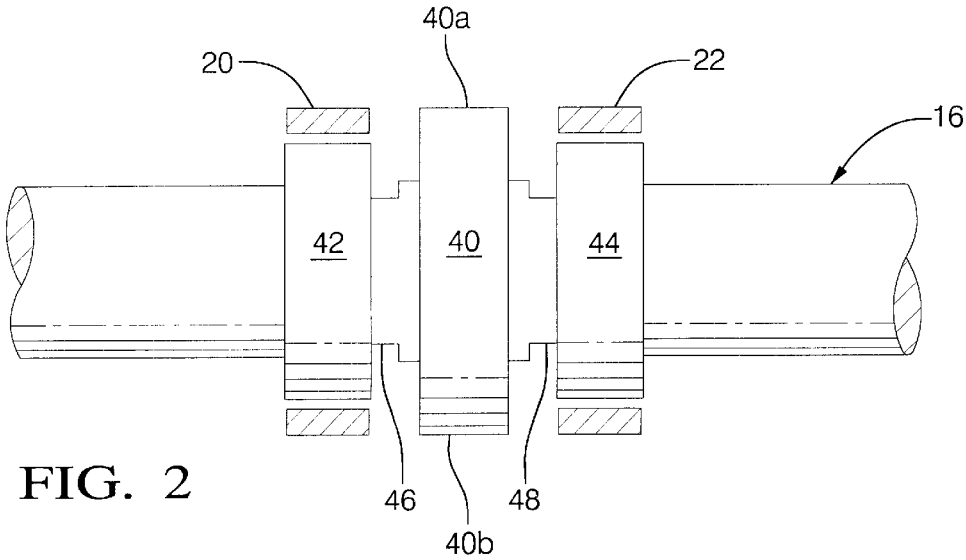
FIG. 2 is a perspective cross-sectional view of a section of the camshaft of FIG. 1.

Camshaft 16, as best shown in FIG. 2, is an elongate shaft member that includes lift lobe 40, null lobes 42, 44, and grooves 46, 48. Lift lobe 40 has base circle portion 40*a* and nose portion or lift profile 40*b*. Null lobes 42, 44 are each disposed on a respective side of and spaced apart from lift lobe 40. Null lobes 42, 44 have a diameter that is a predetermined amount less than the diameter of base circle portion 40*a* of lift lobe 40. Each of grooves 46, 48 are disposed between a corresponding one of null lobes 42, 44 and lift lobe 40. Each of lift lobe 40 and null lobes 42, 44 are affixed to or formed integrally with camshaft 16.

Figure 3:
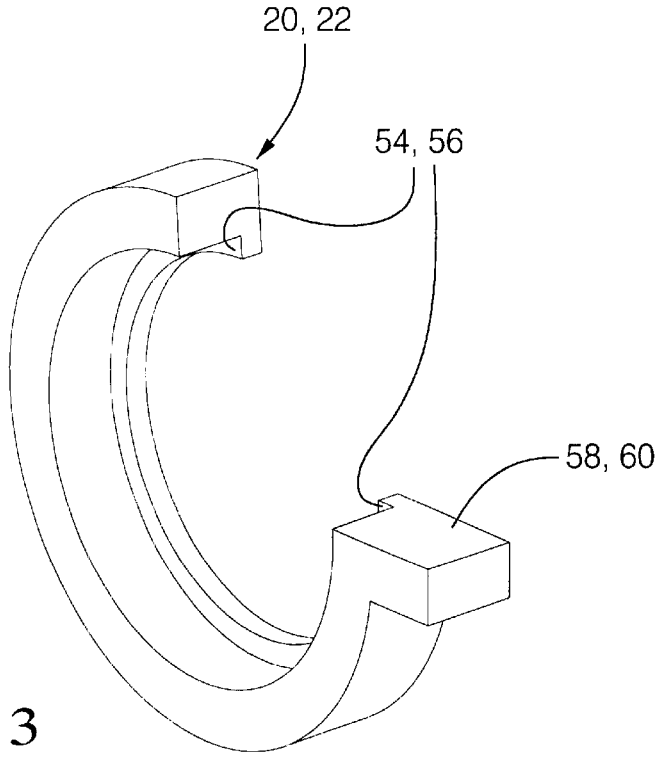
FIG. 3 is a perspective view of the journal bearings of FIG. 1.

Partial journal bearings 20, 22 are disposed on null lobes 42, 44, respectively. Partial journal bearings 20, 22 have an outside diameter that is substantially equal to the diameter of base circle portion 40*a* of lift lobe 40. Partial journal bearings 20, 22 are substantially semi-circular in shape, each having respective open portions 50, 52, bearing lips 54, 56 (FIG. 3), and bearing tangs 58, 60.

The size of open portions 50, 52, i.e., the length of the arc of open portions 50, 52, is selected to be greater than the diameter of camshaft 16. Partial journal bearings 20, 22 are assembled onto null lobes 42, 44 by passing open portions 50, 52 over camshaft 16, and then moving partial journal bearings 20, 22 axially to thereby dispose the inner axial surfaces thereof over the outside surfaces of null lobes 42, 44, respectively. Partial journal bearings 20, 22 are somewhat elastic to permit expansion thereof and thereby allow lips 54, 56 to clear null lobes 42, 44 and be seated within grooves 46, 48, respectively. Thus, partial journal bearings 20, 22 are retained in operable disposition upon camshaft 16, and a supplier can pre-assemble the bearings 20, 22 onto camshaft 16 prior to shipping the assembly to an engine and/or automobile manufacturing plant.

Bearing lips 54, 56 extend in a radially inward direction from the side of a corresponding partial journal bearing 20, 22 that is disposed nearest lift lobe 40. Bearing lips 54, 56 are received within grooves 46, 48, respectively, of camshaft 16, and thereby substantially preclude axial movement of partial journal bearings 20, 22 relative to camshaft 16 and, thus, relative to DRFF 14.

Bearing tangs 58, 60 each engage bearing ledge 64 (FIG. 1), such as, for example, the head casting, that is affixed to or integral with engine 12. The engagement of bearing tangs 58, 60 with bearing ledge 64 substantially precludes rotation or pivoting of partial journal bearings 20, 22 relative to camshaft 16 and, thus, relative to DRFF 14.

Figure 4:
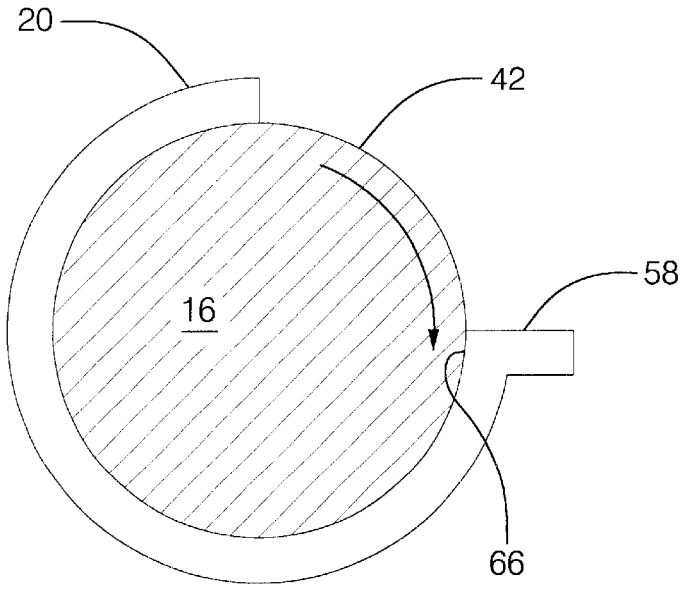
FIG. 4 is a side view of one of the journal bearing of FIG. 1.

As best shown in FIG. 4, each of partial journal bearings 20, 22 (only one shown) include a respective angled portion 66 disposed proximate a corresponding bearing tang 58, 60. Angled portions 66 diverge in a generally radial or tangential direction. Thus, when operably positioned on camshaft 16, angled portions 16 diverge away from camshaft 16 in a generally radial or tangential direction.

In use, and as described above, DRFF 14 is selectively switched between a coupled mode and a decoupled mode of operation. In the coupled mode, DRFF 14 transfers rotary motion of camshaft 14 to vertical motion of valve stem 36 to thereby reciprocate the associated valve. Further, in the coupled mode, partial bearings 20, 22 periodically engage top surfaces 30*a*, 32*a*, respectively. More particularly, as lift lobe 40 rotates, typically in the clockwise direction, lift lobe 40 engages and acts upon roller 28 to thereby pivot DRFF body 26 relative to lash adjuster 34. Thus, when nose or lift portion 40*b* of lift lobe 40 engages roller 28, top surfaces 30*a*, 32*a* of body 26 are also pivoted about lash adjuster 34. Top surfaces 30*a*, 32*a* are pivoted first in a direction away from, and then in a direction towards, partial bearings 20, 22. When roller 28 is engaged by base circle portion 40*a* of lift lobe 40, top surfaces 30*a*, 32*a* engage partial journal bearings 20, 22, respectively. A valve spring (not shown) biases DRFF 14 and body 26 thereof in the direction of camshaft 16.

In the decoupled mode of operation, roller 28 is not coupled to body 26 of DRFF 14. Thus, rotary motion of lift lobe 40 is not transferred via pivotal movement of body 26 to reciprocation of valve stem 36. Top surfaces 30*a*, 32*a* are substantially continually in engagement with partial bearings 20, 22. More particularly, as camshaft 16 and thus lift lobe 40 rotate, lift lobe 40 acts on roller 28. Roller 28 is decoupled from body 26 and therefore translates independently thereof. Body 26 is not pivoted when DRFF 14 is in the decoupled mode of operation. Therefore top surfaces 30*a*, 32*a* of body 26 are not pivoted toward or away from camshaft 16 when DRFF 14 is in the decoupled mode of operation. Thus, partial bearings 26, 28 substantially continually engage peak surfaces 30*a*, 32*a* of DRFF body 26 with DRFF 14 in the decoupled mode of operation.

The locking pin assembly includes a pin that is carried within the hollow shaft of DRFF 14, and switching of modes can occur only when that pin is in alignment with the other pins of the locking pin assembly. The pins are aligned for switching of modes when roller 28 is in engagement with base circle portion 40*a* of lift lobe 40. Any variation or shift in the position of body 26, caused by, for example, pump-up of lash adjuster or wear of either null lobes 42, 44 or surfaces 30*a*, 32*a* engaged thereby, may cause unpredictability in the switching of the locking pin assembly (not shown) of DRFF 14. More particularly, a shift in the position of body 26 toward or away from camshaft 14 can result in a misalignment of the pins of the locking pin assembly relative to each other and/or relative to DRFF body 26, which may render switching of the locking pin assembly unpredictable. Further, such a shift in the position of body 26 may increase the load on roller 28 and, thus, upon hollow shaft of DRFF 14, a condition which may also interfere with predictable switching of the locking pin assembly.

Switching of DRFF 14 from the decoupled mode into the coupled mode occurs when base circle portion 40*a* of lift lobe 40 engages roller 28. A lost motion spring (not shown) biases roller 28, and thus the hollow shaft, into engagement with lift lobe 40. When base circle portion 40*a* of lift lobe 40 engages roller 28 the hollow shaft is biased by the lost motion spring into a position which aligns the pin carried by the hollow shaft with the other pins of the locking pin assembly. A shift in the position of DRFF body 26 affects the position of both roller 28, and thus the hollow, shaft relative to body 26 when roller 28 is engaged by base circle portion 40*a* of lift lobe 40. More particularly, a shift in the position of DRFF body 26 in the direction, for example, toward camshaft 16 results in roller 28 and the hollow shaft being disposed in a lower position relative to DRFF body 26 when base circle portion 40*a* of lift lobe 40 engages roller 28. Thus, the locking pin carried by the hollow shaft will be out of, i.e., lower in, alignment relative to the other pins of the locking pin assembly, and switching of modes may therefore be unpredictable.

Switching of DRFF 14 from the coupled mode into the decoupled mode also occurs when base circle portion 40*a* of lift lobe 40 engages roller 28. In the coupled mode, a valve spring (not shown) of the engine valve associated with DRFF 14 biases body 26 into a position where roller 28, and thus the hollow shaft, engage lift lobe 40. When base circle portion 40*a* of lift lobe 40 engages roller 28, roller 28 and the hollow shaft are essentially unloaded, and thus the pin carried by the hollow shaft is aligned with the other pins of the locking pin assembly. A shift in the position of DRFF body 26 affects the loading upon roller 28, and thus of the hollow shaft. A shift in the position of body 26 in a direction toward camshaft 16 will increase the loading upon roller 28 and the hollow shaft. If the shift in position of body 26 is sufficiently large, switching of the locking pin assembly may become unpredictable.

There is no pressure oil feed to journal bearings 20, 22. Angled portions 66 of journal bearings 20, 22 enhance the lubrication of the interface of the radial inside surfaces of partial journal bearings 20, 22 and the radial outer surfaces of null lobes 42, 44 by providing a "splash" oil flow path. More particularly, as the various moving components of engine 12 that are disposed in the proximity of journal bearings 20, 22 rotate or otherwise undergo motion, oil will be thrown or will splash off of these various components. Angled portions 66 enable any oil that is splashed onto the surface of null lobes 42, 44 exposed by open portions 50, 52, and any oil splashed onto angled portions 66, to run into the gap between angled portions 66 and a corresponding null lobe 42, 44. The oil is drawn into the interface of the inside surface of partial journal bearings 20, 22 and the outer surfaces of null lobes 42, 44 by the rotation of camshaft 16 and null lobes 42, 44. Additionally, or alternatively, although not shown, the width of the bearings 20, 22 can be flared at the ends thereof proximate bearing tangs 58, 60 to further enhance the catching of oil spray. Further, dedicated oil spray from a nozzle or other source and/or self-lubricated bearings can be employed.

Partial journal bearings 20, 22, by reducing frictional wear at the interface of top surfaces 30*a*, 32*a* and null lobes 42, 44, substantially reduces any shift in the position of DRFF body 26. Thus, predictability of the operation/switching of the locking pin assembly is improved. Friction at the interface of top surfaces 30*a*, 32*a* and null lobes 42, 44 is further reduced by a lubricating material, such as, for example oil, disposed therein.

In the embodiment shown, partial bearings 20, 22 include bearing lips 54, 56 that engage grooves 46, 48 to thereby prevent axial movement of partial bearings 20, 22 relative to camshaft 16. However, it should be understood that the present invention can be alternately configured, such as, for example, without grooves and bearing lips. The partial journal bearing on the cam tower side of the lift lobe is trapped between the cam tower and the lift lobe. Thus, no groove or bearing lip is necessary on the cam tower side. On the opposite side, an alternate configuration, such as, for example, a ring clip secured to the camshaft proximate the partial journal bearing, can be used to prevent axial movement of the journal bearing.

In the embodiment shown, partial journal bearings 20, 22 are partial journal bearings. However, it is to be understood that the present invention can be alternately configured, such as, for example, with full bearings and a corresponding assembly procedure.

In the embodiment shown, partial journal bearings 20, 22 have an outside diameter that is substantially equal to the diameter of base circle portion 40*a* of lift lobe 40. However, it is to be understood that the partial journal bearings of the present invention can be alternately configured, such as, for example, with an outside diameter of greater or lesser than the base circle of the lift lobe of the camshaft.

In the embodiment shown, bearing ledge 64, in conjunction with bearing tangs 58, 60, prevents clockwise rotation of journal bearings 20, 22. However, it is to be understood that the present invention can be alternately configured to include bearing ledges that prevent counter-clockwise rotation of the journal bearings, such as, for example, in a V-engine having right and left banks which are mirror images of each other.

It should be particularly noted that the thickness of the partial journal bearings and the diameter of the null lobes must be controlled in order to minimize variation in locking pin lash.

What is claimed:

1. A valve deactivation assembly for use in an internal combustion engine, said valve deactivation assembly comprising:

an elongate camshaft, including:

at least one lift lobe having a lift portion and a base circle portion, said at least one lift lobe being one of affixed to and integral with said camshaft;

a first null lobe disposed on a first side of each said at least one lift lobe, said first null lobe being one of affixed to and integral with said camshaft;

a second null lobe disposed on a second side of each said at least one lift lobe, said second null lobe being one of affixed to and integral with said camshaft;

a first journal bearing disposed on said first null lobe;

a second journal bearing disposed on said second null lobe; and at least one roller finger follower, each said at least one roller finger follower being associated with a corresponding one of said at least one lift lobe, each said at least one roller finger follower having a respective body, said first and second journal bearings engaging a respective surface of said body.

2. The valve deactivation assembly of claim 1, wherein each of said first and second journal bearings are partial journal bearings.

3. The valve deactivation assembly of claim 2, wherein each of said first and second journal bearings include respective open portions, said open portions dimensioned to receive said camshaft.

4. The valve deactivation assembly of claim 3, wherein each of said first and second journal bearings further comprise angled portions disposed proximate a corresponding open portion, said angled portions diverging in one of a generally radial and tangential outward direction relative to and away from said cam shaft.

5. The valve deactivation assembly of claim 1, wherein said first and second journal bearings further comprise a respective first and second tang configured for engaging a surface of an engine.

6. The valve deactivation assembly of claim 1, wherein said first null lobe and said second null lobe have a null lobe diameter, said null lobe diameter being a predetermined amount less than a diameter of said base circle portion of a corresponding one of said at least one lift lobe.

7. The valve deactivation assembly of claim 1, wherein said first and second journal bearings have an outside diameter substantially equal to a diameter of said base circle portion of said at least one lift lobe.

8. The valve deactivation assembly of claim 1, wherein said camshaft defines first and second grooves, each of said first and second grooves disposed proximate a corresponding one of said first and second null lobes.

9. The valve deactivation assembly of claim 8, wherein said first and second grooves are disposed intermediate said lift lobe and a corresponding one of said first and second null lobes.

10. The valve deactivation assembly of claim 8, wherein said first and second partial journal bearings further comprise a respective lip, each said lip extending radially inward from a surface of a corresponding one of said first and second partial journal bearings and configured for being disposed in a corresponding one of said first and second grooves.

11. An internal combustion engine, comprising:

an elongate camshaft, including:

at least one lift lobe having a lift portion and a base circle portion, said at least one lift lobe being one of affixed to and integral with said camshaft;

a first null lobe disposed on a first side of each said at least one lift lobe, said first null lobe being one of affixed to and integral with said camshaft;

a second null lobe disposed on a second side of each said at least one lift lobe, said second null lobe being one of affixed to and integral with said camshaft;

a first journal bearing disposed on said first null lobe;

a second journal bearing disposed on said second null lobe; and at least one roller finger follower, each said at least one roller finger follower being associated with a corresponding one of said at least one lift lobe, each said at least one roller finger follower having a respective body, said first and second journal bearings engaging a respective surface of said body.

12. The internal combustion engine of claim 11, wherein each of said first and second journal bearings are partial journal bearings.

13. The internal combustion engine of claim 12, wherein each of said first and second journal bearings include respective open portions, said open portions dimensioned to receive said camshaft.

14. The internal combustion engine of claim 13, wherein each of said first and second journal bearings further comprise angled portions disposed proximate a corresponding open portion, said angled portions diverging in one of a generally radial and tangential direction away from said camshaft.

* * * * *